US007676864B2

(12) United States Patent
Lee

(10) Patent No.: US 7,676,864 B2
(45) Date of Patent: Mar. 16, 2010

(54) BEDDING SYSTEM AND METHOD FOR ACCOMMODATING PERSONAL TEMPERATURE COMFORT DIFFERENCES

(76) Inventor: Nikki Lee, 4377 E. Mesquite Desert Trl, Tuscon, AZ (US) 85706

( * ) Notice: Subject to any disclaimer, the term of this patent is extended or adjusted under 35 U.S.C. 154(b) by 0 days.

(21) Appl. No.: 12/384,520

(22) Filed: Apr. 6, 2009

(65) Prior Publication Data

US 2009/0249547 A1 Oct. 8, 2009

Related U.S. Application Data

(60) Provisional application No. 61/042,963, filed on Apr. 7, 2008.

(51) Int. Cl.
*A47G 9/04* (2006.01)

(52) U.S. Cl. ..... 5/502; 5/482

(58) Field of Classification Search ..... 5/486, 5/413 R, 482, 502; 2/69.5
See application file for complete search history.

(56) References Cited

U.S. PATENT DOCUMENTS

| | | | | | |
|---|---|---|---|---|---|
| 3,510,889 | A * | 5/1970 | Peterson | 5/413 R |
| 3,530,516 | A * | 9/1970 | Marquette | 5/486 |
| 5,251,350 | A * | 10/1993 | Bordenave et al. | 5/482 |
| 5,713,089 | A * | 2/1998 | Ferrante | 5/502 |
| 5,887,299 | A * | 3/1999 | Phillips | 5/413 R |
| 6,338,173 | B1 * | 1/2002 | Ramsey | 5/413 R |
| 2003/0217411 | A1 * | 11/2003 | Bradley et al. | 5/486 |

* cited by examiner

*Primary Examiner*—Alexander Grosz

(57) ABSTRACT

A comforter is provided having a length and width dimension larger than commercially available comforters. A flexible slidable fastener is provided along the length of the comforter substantially in the middle of the width dimension of the comforter. The flexible slidable fastener may be covered to prevent irritation to the occupants of the bed on which the comforter of the present invention is placed.

3 Claims, 5 Drawing Sheets

BEDDING SYSTEM AND METHOD FOR ACCOMMODATING PERSONAL TEMPERATURE COMFORT DIFFERENCES

CROSS REFERENCE TO RELATED APPLICATION

This application claims the benefit of Provisional U.S. Patent Application No. 61/042,963, filed Apr. 7, 2008

STATEMENT REGARDING FEDERALLY FUNDED RESEARCH AND DEVELOPMENT

The invention described in this patent application was not the subject of federally sponsored research or development.

FIELD

The present invention pertains to improvements in bedding; more particularly the present invention pertains to an improvement in an item of bedding commonly known as a comforter. As used herein, the term "comforter" shall include bedspreads, duvets and the like.

BACKGROUND

In many parts of the country, comforters are found on the beds in many households. While many comforters are lighter than blankets and thereby preferred by many as a bed cover, such comforters are not without their problems. One of these problems has arisen because the size of the beds found in many households has increased. At one time, the bedrooms in many houses featured one or two twin beds or a double bed. Now it is not unusual to find either a queen size bed or a king size bed in a bedroom. An even larger bed called a California King is now becoming popular. To cover a queen size bed, a king size bed or a California king size bed, bedding manufacturers have made larger and larger comforters.

The first problem is that while the size of comforters has increased most homeowners have not upsized their home laundry equipment to handle these larger comforters. The result is that large comforters are difficult, if not impossible, to load into home washing machines. Thus, large comforters must be taken out to a commercial laundry for dry cleaning or washing. Others take their large comforters to a laundromat featuring washers made to accommodate oversized loads.

When a large comforter is stuffed into a home washing machine, the size of a large comforter prohibits a thorough washing. This stuffing of a large comforter into a home washer creates its own set of problems. First, the comforter may not get properly cleaned as the soapy water in the washing machine may not be able to reach all parts of the large comforter. Second, the agitator may actually cause the batting or material in the large comforter to move around within the comforter and form undesirable clumps. Third, overloading a home washing machine may cause damage to the home washing machine.

After the comforter has been washed, most homeowners find that it may take several cycles of a dryer to dry these larger comforters if the larger comforter can even be dried at all. As with home washing machines, attempting to stuff a dryer with a large comforter may damage the home dryer.

Such problems with regard to the laundering of large comforters have become known to manufacturers of large comforters. In response, most manufacturers of large comforters have been reluctant to further increase the size of comforters provided for use on a queen size bed, a king size bed or a California king sized bed as such an increase in size would only exacerbate laundering problems.

A second problem occurs when large comforters are used on a queen size bed, king size bed or California king sized bed. When one occupant of a bed becomes too warm while sleeping, the tendency is to throw the large comforter toward the other side of the bed. This causes the comforter to double up over the other occupant of the bed. This doubling up of the comforter may cause the other occupant of the bed to become too warm. The result is that the large comforter winds up as a big lump in the middle of the queen size bed, the king size bed or the California king size bed and neither occupant of the bed is able to achieve the desired level of body temperature comfort. The big lump of a large comforter in the middle of the bed is like adding another occupant to the bed. With a portion of the bed space now devoted to the large comforter the purpose of having a large bed is defeated.

There is therefore a need in the art for a bedding system which will accommodate the personal temperature comfort differences of the occupants of a bed and can be easy to launder in the washing machines and dryers found in most homes.

SUMMARY

There is provided by the present invention a bedding system and method which will accommodate the personal comfort temperature differences of the occupants of a bed and can still be laundered in the washers and dryers found in most homes.

The comforter of the present invention is made to be larger than generally available comforters. It includes a top layer of fabric and a bottom layer of fabric. Both the length and width dimension of the disclosed comforter are larger than the length and width dimension of commonly available comforters. The bottom layer and top layers of fabric are connected at their edges to form a pocket. Thermal insulating material, polyfil or down batting is placed in the pocket. A flexible slidable fastener is positioned substantially half way along the width of the comforter. The flexible slidable fastener runs the entire length of the comforter enabling separation of the disclosed comforter into two parts. The flexible slidable fastener is chosen to be small enough to not be an irritant to those under the comforter should they inadvertently roll on the flexible slidable fastener but still large enough to enable holding the comforter together.

To further protect the occupants of the bed from the flexible slidable fastener, the flexible slidable fastener is covered. The cover prevents contact between the flexible slidable fastener and the skin of either occupant of the bed.

To prevent the comforter of the present invention from sliding off the bed, the bottom layer of fabric is selected to not easily slide off the bed.

BRIEF DESCRIPTION OF THE DRAWING FIGURES

A still better understanding of the system and method of the present invention may be had by reference to the drawing figures which include reference numbers to explain the various parts thereof. The reference numbers are described in the following section entitled DESCRIPTION OF THE EMBODIMENTS. It should be understood that the drawing figures are not to scale and that certain details have been omitted. Such details are not necessary for an understanding of the present invention and include details regarding fabrication and assembly. The attached drawing figures include:

DESCRIPTION OF THE EMBODIMENTS

The comforter of the present invention is used with a commonly used bed which includes a box spring and a mattress placed on the box spring. The box spring and mattress are similarly sized. Most beds also include a frame which supports the similarly sized box spring and mattress over the floor on which the bed is positioned. The comforter of the present invention is sized to cover the mattress and hang down at least below the bottom of the box spring but not to rest on the floor surrounding the bed unless the box spring in placed on a floor. Accordingly, the comforter is made large enough to mask the sides of both the mattress and the box spring.

Figure 1:
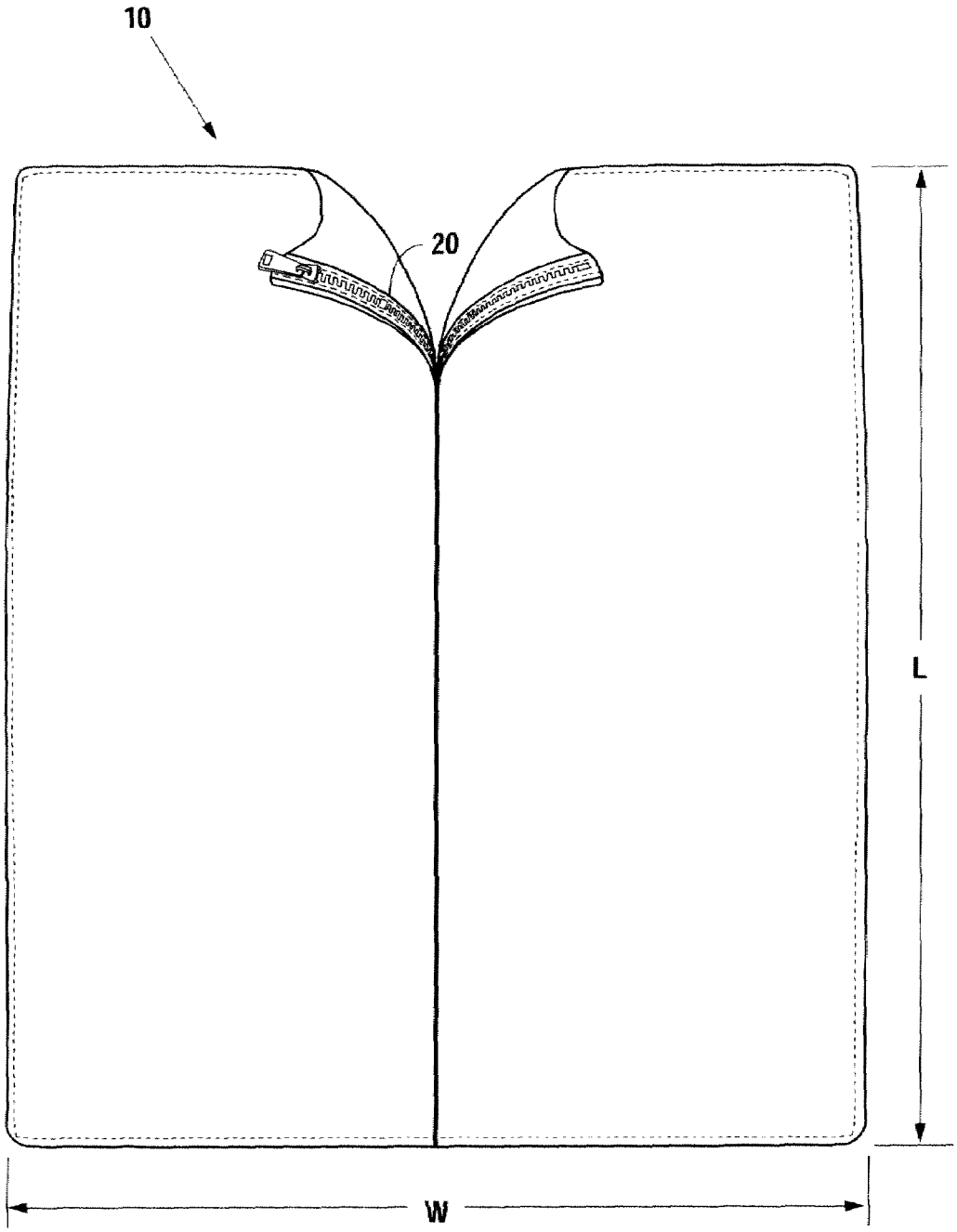
FIG. 1 is a top plan view of the comforter of the present invention showing the flexible slidable fastener in a partially open position.

As may be seen in FIG. 1, the comforter 10 of the present invention has a length dimension L and a width dimension W. The length dimension L and the width dimension W are selected to be larger than what is commonly available for bedding sized to fit queen, king or California king sized beds. Specifically, commercially available bedding is generally made according to the following table.

| | Length | Width |
|---|---|---|
| Queen Size | 86" | 86" |
| King Size | 90" | 100" |
| California King Size | 90" | 100" |

According to the present invention, the size of the disclosed comforter has been enlarged from about 10% to about 15% over the generally available commercial bedding according to the following table.

| | Length | Width |
|---|---|---|
| Queen | 96-100" | 94-98" |
| King | 96-100" | 110-105" |
| California King | 96-100" | 110-115" |

The enlarged size of the comforter described above would not typically be acceptable as it could not be easily washed or dried in a typical home washer and dryer.

The present invention solves the launderability problem of the present invention by enabling the disclosed comforter to be split into two substantially equal size pieces along a line substantially paralled to the edge of the comforter designated by "L" in FIG. 1. Each of these two substantially equal size pieces may now be easily washed and dried by home laundry equipment. Once washed the two pieces may then be put back together before placing on a bed. This connection is made by the use of a flexible slidable fastener as described below.

The present invention also solves the problem of providing a method for accommodating personal temperature comfort differences. Specifically, one occupant of a bed including the comforter 10 of the present invention may be only partially covered while the other occupant of the bed remains completely covered. This advantage provided by the disclosed invention is accomplished by sliding the flexible slidable fastener 20 part way down its length and folding a portion of the comforter back upon itself. This folding of the unzipped portion of the comforter substantially along a line parallel to its width dimension "W" enables one occupant of the bed to be partially covered and the other occupant of the bed to be covered.

Because it is not uncommon for the occupants of a bed to roll around and move while sleeping, there is a problem that the flexible slidable fastener 20 may chafe against the exposed skin of one of the occupants of the bed. There is also the problem that the flexible slidable fastener 20 may feel hard against the skin of one of the occupants of the bed and thereby become an irritant which may hamper restful sleep. To solve this problem, the flexible slidable fastener has been chosen to have maximum flexibility and minimum size. It has been determined that a coil type plastic or nylon zipper having a size range from about 45 CF to about 7 CF will provide the flexibility and the small size needed to not disturb the occupants of the bed. At the same time the flexible slidable fastener provides the necessary strength so that the movement of the weight of the occupants of the bed or tugs on the comforter by one of the sleeping occupants of the bed will not cause the flexible slidable fastener to inadvertently separate. A slidable fastener such as part number CF OL-456 DA E offered by YKK Corporation of America will provide suitable results.

Figure 2:
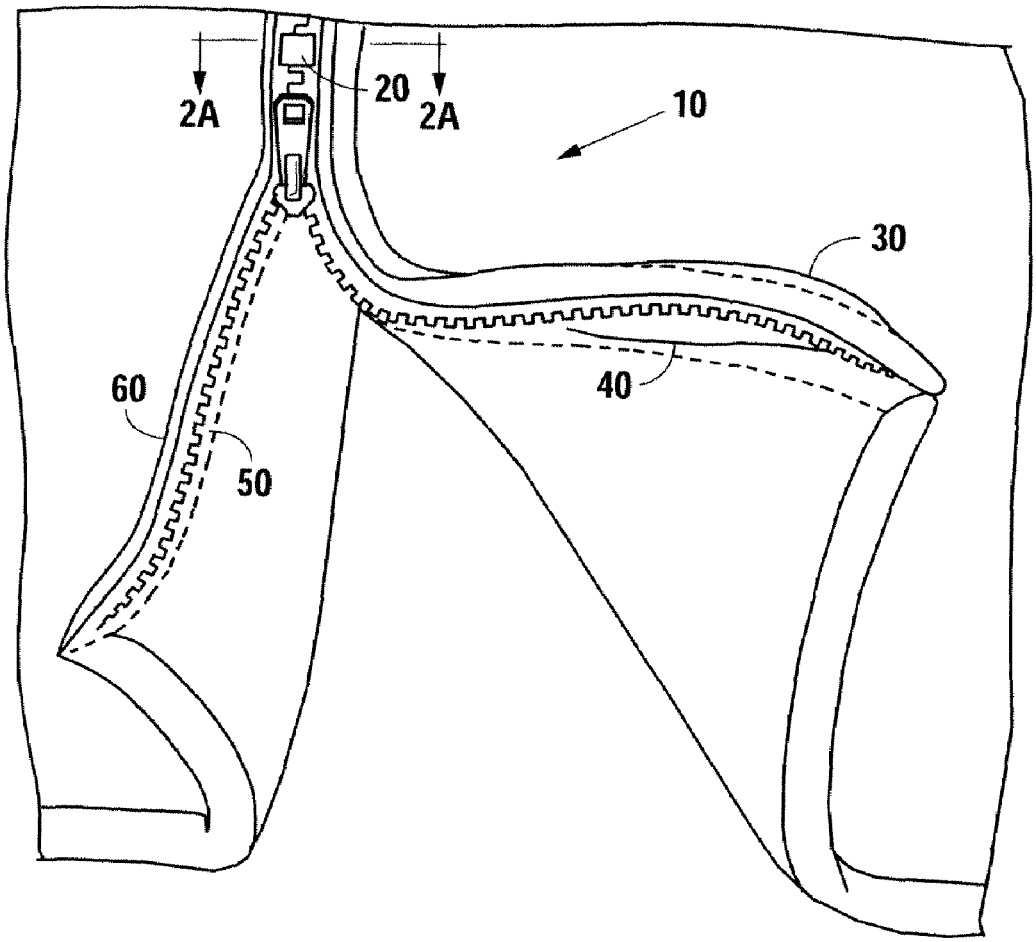
FIG. 2 is an enlarged top plan view similar to FIG. 1 with the covers over the flexible slidable fastener pulled back showing the positions of the flexible slideable fastener.

To further protect the occupant of the bed from having skin chaffed by rubbing against the flexible slidable fastener or causing a ridge to form in the bed which might interrupt the rest of the occupants of the bed, covers 30, 40, 50 and 60 as shown in FIG. 2 are formed to go over the top and bottom of the flexible slidable fastener 20 respectively. In the preferred embodiment, the covers 30, 40, 50 and 60 may be padded to further mask the feeling of a ridge formed down the middle of the sleeping surface if the flexible slidable fastener 20 happens to move under the body of an occupant of the bed or if one of the occupants of the bed rolls over on top of the flexible slidable fastener 20.

Figure 2A:
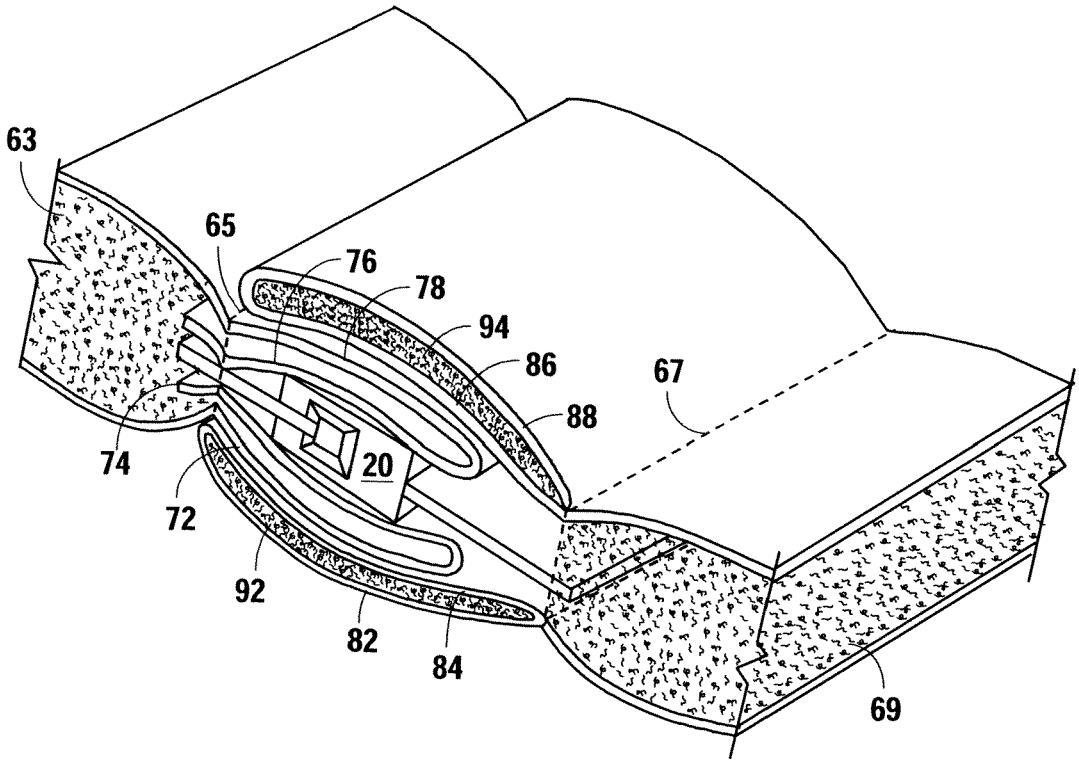
FIG. 2A is an enlarged sectional view at line 2A-2A of FIG. 2.

As shown in FIG. 2A, directly over the flexible slidable fastener 20 are two double layers of fabric 72, 74, 76, 78, which extend over the flexible slidable fastener 20 from the seam 65 near the edge of the thermal insulating material 63. The seam 65 holds one side of the flexible slidable fastener 20 in place. Extending over the double layers of fabric 72, 74, 76, 78 are another two larger double layers of fabric 82, 84, 86, 88 which extend from seam 67 near the edge of the edge of the thermal insulating material 69. The seam 67 holds the other side of the flexible slidable fastener 20 in place. Between the larger layers of fabric 82, 84 is placed polyfil padding 92. Also between larger layers of fabric 86, 88 is polyfil padding 94.

Figure 3:
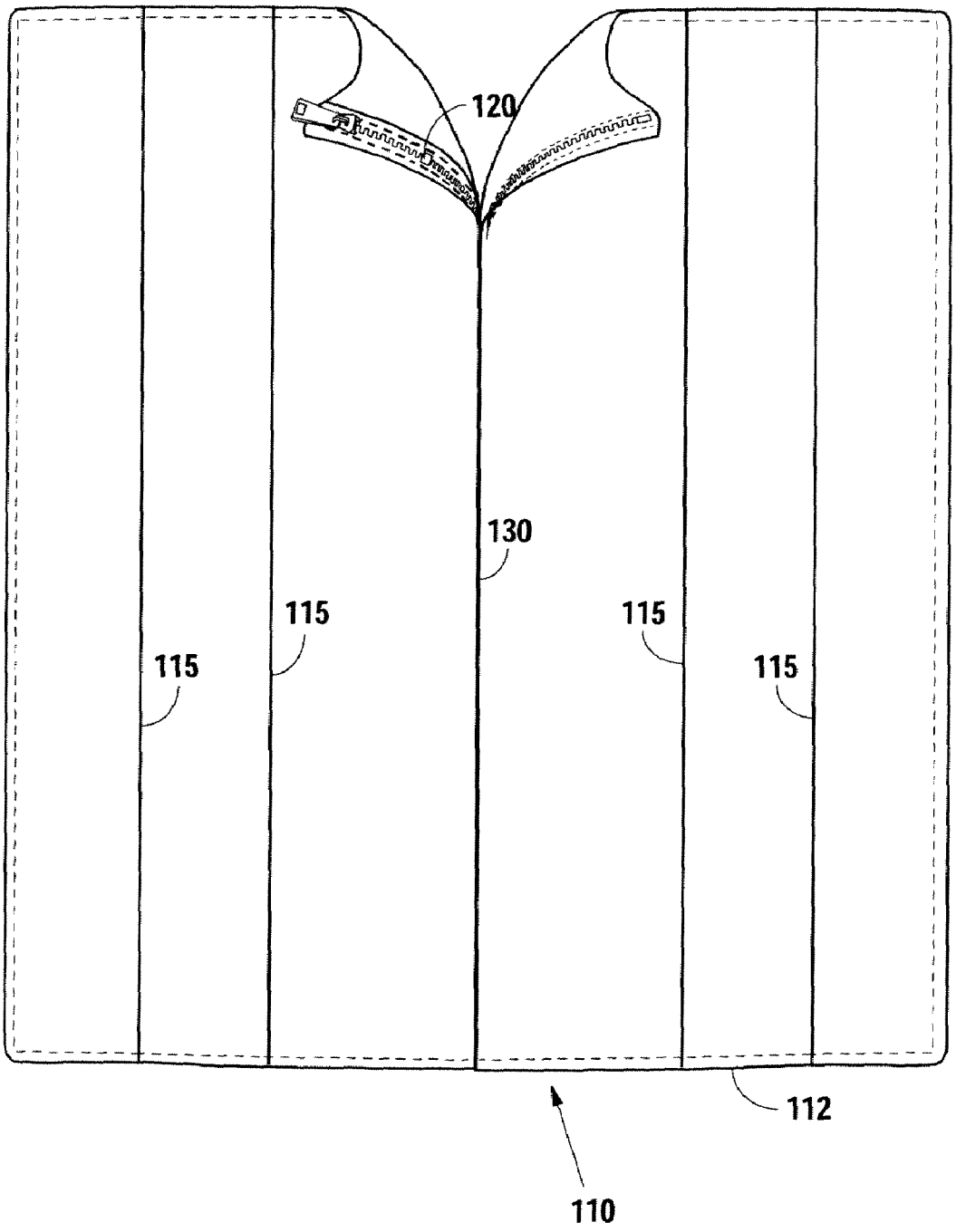
FIG. 3 is a top plan view of an alternate embodiment of the invention including a plurality of ribs running the length thereof.

In an alternate embodiment as shown in FIG. 3, the comforter 110 may include decorative pleats formed substantially parallel to the flexible slideable fastener 120. These decorative pleats 115 have the same appearance as the cover 130 over the flexible slidable fastener 120. Thus the cover 130 over the top of the flexible slidable fastener 120 appears to be part of the design of the top of the comforter.

In yet another embodiment a flexible slidable fastener having large pieces of supporting fabric attached to either side may be used. In this embodiment, the supporting fabric for the flexible slidable fastener appears to be actually incorporated into the design on the top of the comforter.

In still another embodiment plackets (not shown) may be used on the bottom of the comforter.

Another problem with large comforters is that they have a tendency to slide off of a bed. When this happens, the occupants of the bed are left without any covering. To prevent the comforter of the present invention from easily sliding off the bed, the bottom layer of fabric has been selected from a group which includes a sufficiently high coefficient of sliding friction with respect to other bedding, such as cotton sheets, that the weight of the comforter will not generally cause the comforter to slide off the bed when a portion of the comforter is moved off the top of the mattress. For example, one possible fabric for the bottom layer would be a micro-fiber, poly cotton blend. Other possibilities include woven fabrics or quilted fabrics made from cotton, silk, hemp, linen, flannel, polyester or other similar materials. A suitable fabric called "Whisper Polin" having a 65% polyester/35% cotton blend offered by Carr Textile Corporation will provide suitable results.

Figure 4:
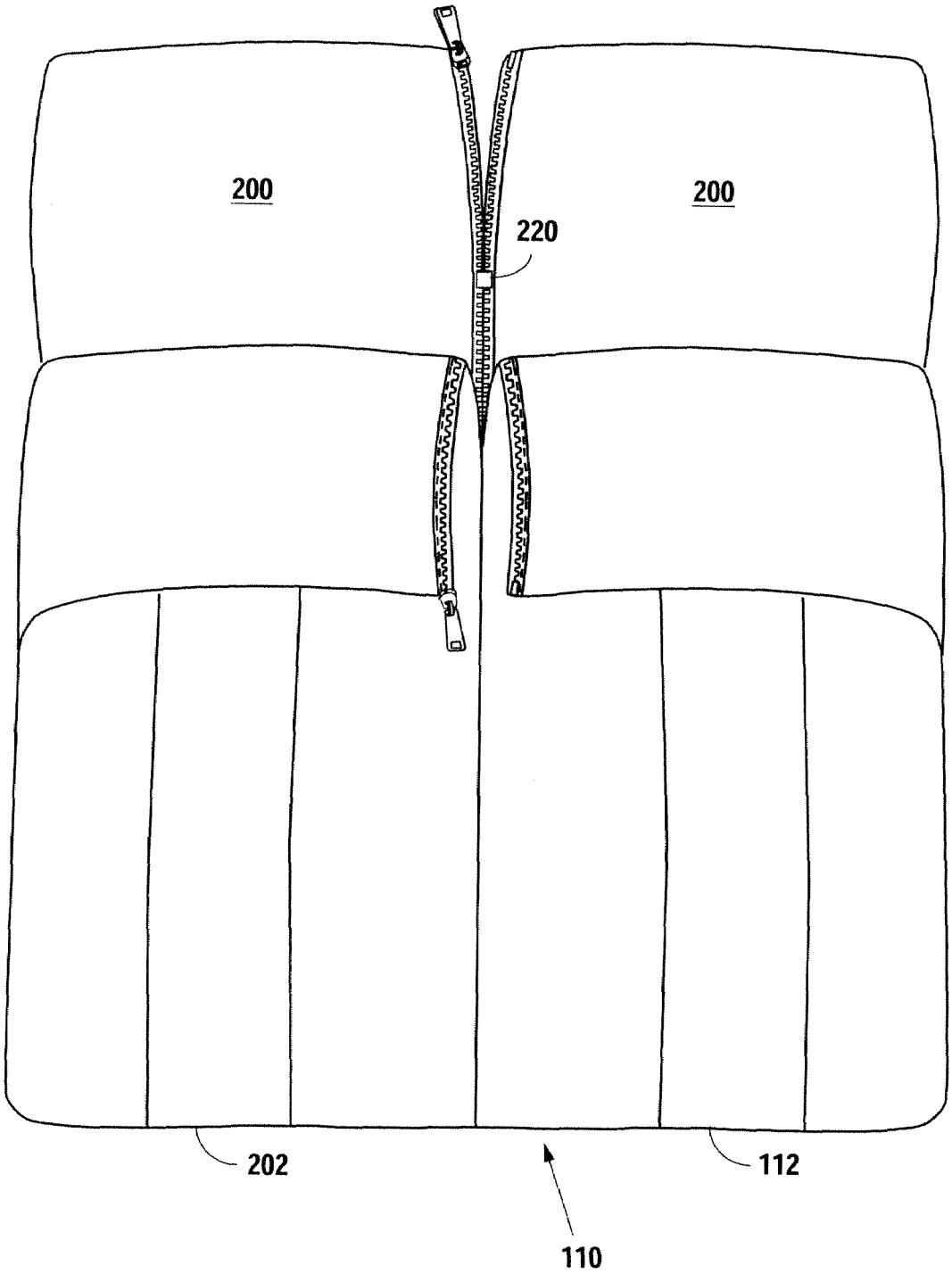
FIG. 4 is a perspective view of a comforter and sheet set.

In an alternate embodiment of the invention, the comforter 10, 110 will have an optional sheet 200 as shown in FIG. 4. The sheet 200 is partially split along its length and a flexible slidabe fastener 220 is sewn therein to allow partial separation of the sheet. The flexible slidable fastener is selected to provide minimal discomfort to the occupants of the bed but strong enough to hold the sheet together. In yet another alternate embodiment, means for attachment of the bottom 202 of the sheet 200 shown in FIG. 4 is formed to be attachable to the bottom 112 of the comforter 110 by its occupants. Such means may include snaps, buttons, hook and loop, a flexible slidable fastener on the bottom 202 of the sheet 200. This bottom 202 of the sheet 200 may actually be sewn to the bottom 112 of the comforter 110. The attachment of the bottom 202 of the sheet 200 to the bottom 112 of the comforter 110 facilitates making up the bed before or after it is used.

While the present invention has been described according to its preferred and alternate embodiments, those of ordinary skill in the art will realize that still other embodiments of the present invention have been enabled by the foregoing disclosure. Such other embodiments shall be included within the scope and meaning of the appended claims.

What is claimed is:

1. A bed comforter comprising:

a top layer of fabric having a length dimension and a width dimension, a bottom layer of fabric having a length dimension and a width dimension substantially the same as said length dimension and said width dimension of said top layer of fabric, said bottom layer of fabric being selected from a group having a sufficiently high coefficient of sliding friction to not slide off the bed;

said top layer of fabric and said bottom layer being connected to each other at their edges to form a space therebetween;

a thermal insulating material constructed and arranged for filling said space between said top layer of fabric and said bottom layer of fabric;

a flexible slidable fastener positioned substantially at the halfway point of said width dimension and extending said length dimension of said top layer of fabric and said bottom layer of fabric, said flexible slidable fastener being a coil type nylon or plastic zipper;

said zipper dividing the comforter into a first panel and a second panel, with a first portion of the zipper being retained by a first seam between a top and bottom fabric layer of the first panel and a second portion of the zipper being retained by a second seam between a top and bottom fabric layer of the second panel;

a flexible zipper cover formed of two inner fabric layers and two outer fabric layers, the inner layers comprising double layers of fabric extending from the first seam and sized to extend above and below a substantial portion of the zipper, and the outer fabric layers comprising double layers of fabric extending from the second seam, sized to extend above and below the inner layers, from the second seam to the first seam;

whereby said bed comforter may be completely taken apart for washing or made adjustable by being partially separated when two people with different personal temperature comfort preferences occupy a bed on which the comforter is placed.

2. The comforter as defined in claim 1 further including a plurality of decorative pleats similar to said flexible slidable fastener cover formed from said top layer of fabric whereby said flexible slidable fastener cover formed from said top layer of fabric appears to be part of the design of the top of the comforter.

3. The comforter as defined in claim 1 wherein said flexible slidable fastener cover formed on one side of said flexible slidable fastener includes padding therein.

* * * * *